US005971244A

United States Patent [19]

Jaeger

[11] Patent Number: 5,971,244

[45] Date of Patent: Oct. 26, 1999

[54] BACKPACK

[75] Inventor: Knut Jaeger, Kirchheim-Teck, Germany

[73] Assignee: Big Pack GmbH, Bissengen-Teck, Germany

[21] Appl. No.: 08/902,342

[22] Filed: Jul. 29, 1997

[30] Foreign Application Priority Data

Jul. 30, 1996 [DE] Germany ..... 296 13 188
Oct. 24, 1996 [DE] Germany ..... 296 16 580

[51] Int. Cl.[6] ..... A45F 3/08

[52] U.S. Cl. ..... 224/632; 224/633; 224/637; 224/635; 224/644

[58] Field of Search ..... 224/633, 636, 224/637, 630, 631, 632, 634, 635, 644, 628

[56] References Cited

U.S. PATENT DOCUMENTS 4,479,595 10/1984 Opsal ..... 224/630
5,341,974 8/1994 Robinson et al. ..... 224/633

FOREIGN PATENT DOCUMENTS 0122764 10/1984 European Pat. Off. .
0551733 7/1993 European Pat. Off. .
2677235 12/1992 France .
2553729 6/1977 Germany .
3045881 7/1982 Germany .
3844675 6/1990 Germany .
29618580 12/1996 Germany .
667195 9/1988 Switzerland .
678796 11/1991 Switzerland .
WO/91/05494 5/1991 WIPO ..... 224/211

*Primary Examiner*—Linda J. Sholl
*Attorney, Agent, or Firm*—Dilworth & Barrese

[57] ABSTRACT

A backpack having a bow-shaped frame incorporated into its backside and two carrying straps is provided, in which the carrying straps are attached directly or indirectly to a strap that can be adjustably slid longitudinally along the backpack backside, and is connected to the backpack by its free ends in an area in which free ends of the bow-shaped frame end.

10 Claims, 1 Drawing Sheet

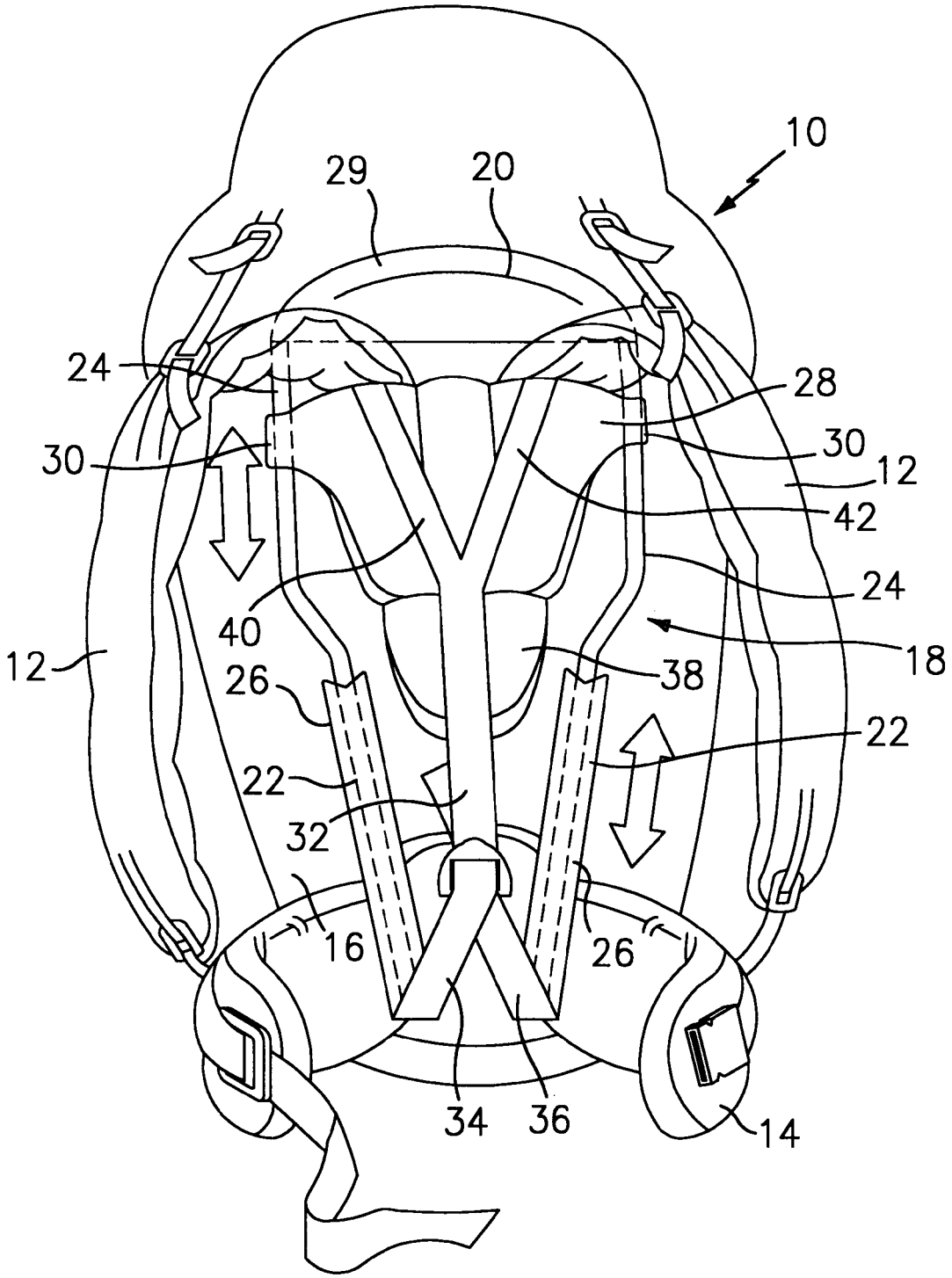
*Figure*

BACKPACK

BACKGROUND OF THE INVENTION

The invention concerns a backpack provided with a bow-shaped frame incorporated into its backside and two carrying straps.

Backpacks with incorporated bow-shaped frames, intended to improve the stability of the backpack, are already known. To adjust the backpack to the carrier's anatomy, adjustable-position carrier straps are also already known. The carrying height of the backpack can be adjusted according to the length of the back. The free ends of the adjustable carrier straps fit on one hand into the top part of the backpack, on the other hand into the bottom part of the backpack. The principal energy component of the load-bearing capacity is thus introduced into the top part of the backpack.

SUMMARY OF THE INVENTION

The object of the invention is to perfect a generic backpack of such nature that the load is better distributed and carrying comfort is thereby improved.

According to the invention, this task is performed on a generic backpack by means of the characteristic features of the carrying straps being attached directly or indirectly to a strap that can be adjustably slid longitudinally on the backpack backside, this adjustable strap being connected with the backpack by its free ends in an area in which free ends of the bow-shaped frame end. According to these features, one end of the carrying straps fits into a longitudinally adjustable cushion positioned on the backside of the backpack. Additionally connected with the cushion is an adjustable strap that divides and the ends of which are connected with the bottom part of the backpack at the point at which the free ends of the bow-shaped frame end. The introduction of force is thereby shifted from the upper areas of the carrying straps via the cushion and the adjustable strap connected with the cushion into the bottom part of the backpack side on which the free ends of the bow-shaped frame are positioned. The force is conducted via the bow-shaped frame and in particular is distributed widely via the center crosspiece of the bow-shaped frame that is supported on the backpack backside. A considerably improved distribution of weight in comparison to customary backpacks is thereby achieved.

It is particularly advantageous that by means of the adjustable strap and the cushion the position of the backpack can be adjusted precisely to the length of the back.

Advantageous embodiments of the invention result from the description herein.

According to one advantageous embodiment, the cushion has a loop on each side. By means of these loops the cushion can be slid along the bow-shaped frame. Additionally the cushion can be guided via at least one loop on a strip running along the backpack backside and positioned between and parallel to the bow-shaped frame. This embodiment ensures that the cushion will not move away from the backpack backside and will lie flat against it. Markings for the positioning of the cushion can be placed on the strip running along the backpack backside. The markings correspond to points along the back. The cushion and thereby the carrying straps can be adjusted to the length of the back by simple adjustment and attachment by means of the strap.

According to one advantageous embodiment of the invention the bow-shaped frame can be positioned removably on the backpack backside. Its free ends can be inserted into pockets sewn on the bottom portion of the backpack, while the center crosspiece of the bow-shaped frame can be inserted into a pocket in the top part of the backpack backside.

On its side that is open toward the bottom, the pocket positioned on the backside of the backpack to hold the center crosspiece can be attachable, by means of attachment components, for example Velcro straps or press buttons, to the backpack backside. These attachment components do not accept any forces, but they do close the pocket so that the middle area of the pocket does not get dirty.

The bow-shaped frame can advantageously be made of duralumin tubing. This material has the necessary durability on the one hand and is comparatively light on the other hand. But plastic can also be used as the frame material.

The center crosspiece of the bow-shaped frame can easily be bowed outward, while the side bars when inserted run diagonally toward each other at their ends—that is, they form a V-shape, so that the natural diagonal movement of the body of the carrier experiences the least amount of hindrance when the carrier is walking and climbing—and run essentially parallel in the area between the end and the center crosspiece. This parallel area is the part of the bow-shaped frame along which the cushion with its frame-holding loops slides.

The bow-shaped frame can be shaped three-dimensionally and can thereby be adjusted to the shape of its carrier's back. A preferred adaptation results, for example, from imparting a flattened S shape to the bow-shaped frame.

A padded flap can additionally be placed at the lower end of the cushion and can be connected to the backpack backside by means of attachments, for example Velcro tapes or press buttons. This padded flap covers at least part of the adjustable strap and forms additional cushioning in the area of the carrier's back.

BRIEF DESCRIPTION OF THE DRAWING

Additional details and advantages of the invention are explained in greater detail in the embodiment illustrated in the single FIGURE. The FIGURE shows a rear view of a backpack according to a preferred embodiment of the invention.

DESCRIPTION OF THE PREFERRED EMBODIMENTS

The FIGURE illustrates a backpack 10 that has two padded carrying straps 12 and a hip strap 14. A bow-shaped frame 18 is incorporated into backpack backside 16. The bow-shaped frame 18 is made of duralumin tubing and has essentially five areas. The first area is the center crosspiece 20, which connects the side bars. The side bars are composed of the ends 22 and the areas 24 between the ends 22 and the center crosspiece 20. The ends 22 run diagonally toward each other, forming a V-shape, while the middle areas 24 run essentially parallel to each other. The bow-shaped frame is connected removably with backpack 10 backside 16. Oblong pockets 26 are sewn on the backpack backside, in which said oblong pockets 26 the areas 22, that is, the free ends, of the bow-shaped frame 18 are inserted in mounted condition. The outward-curving center crosspiece 20 rests in a pocket 29 sewn on the backside 16, which said pocket 29 is open at the bottom and can be attached to backside 16 by means of Velcro strips, not further illustrated. The frame 18 open at the bottom is adjusted by means of the indicated shape to the skeletal frame of the carrier and, due to the fact that it is open at the bottom and thus does not form a rigid frame, it ideally adjusts to the natural movement and bending of the upper body.

The carrying straps 12 are permanently attached at their top free end with two branching ends 40, 42 of a strap 32 that runs under a cushion 28. The cushion 28 has side loops 30. The loops 30 run along the essentially parallel areas 24 of the bow-shaped frame 18. In the center and at the bottom the two branching V-shaped strap segments 40 and 42 connect with strap 32, which divides again at the bottom into two segments 34 and 36 and, as illustrated in the FIGURE, can be slid longitudinally. The free ends of segments 34 and 36 are connected with backpack 10 backside 16 in the area in which the free ends of the bow-shaped frame 18 end.

Alternatively, in a manner and way not further illustrated here, the carrier straps 12 can also be permanently attached at their top free ends directly to the cushion 28. In this case the strap 32 attaches at the center and in the bottom area of the cushion 28. In this embodiment there is no V-shaped branching of strap 32 into segments 40 and 42.

Above the strap 32 a padded flap 38 is applied to the cushion 28, which can be connected to the backside 16 by means of Velcro strips not illustrated in detail here.

What is claimed is:

1. Backpack with a bow-shaped frame incorporated into its backside and two carrying straps, wherein the carrying straps are attached to a strap that can be adjustably slid longitudinally on the backpack backside, said adjustable strap being connected with the backpack by free ends thereof in an area in which free ends of the bow-shaped frame end, the bow-shaped frame is removably positioned on the backpack backside, the free ends of the bow-shaped frame can be inserted into the bottom portion of the backpack backside, while a center crosspiece of the bow-shaped frame can be inserted into a pocket in the upper portion of the backpack backside, and the center crosspiece of the bow-shaped frame is curved slightly outward, while bottom portions of sidebars thereof when in mounted position run diagonally toward each other and their middle positions, the area between their bottom portions and the center crosspiece, run essentially parallel.

2. Backpack according to claim 1, wherein the strap is connected with a cushion that has a loop on each side, and by means of these loops, the cushion is mounted to slide along the bow-shaped frame.

3. Backpack according to claim 1, wherein the bow-shaped frame is made of duralumin tubing.

4. Backpack according to claim 1, wherein the bow-shaped frame is three-dimensional in shape and is thereby adapted to the shape of its carrier's back.

5. Backpack according to claim 1, wherein additionally a padded flap is applied to the bottom end of the cushion and can be connected with the backpack backside by means of attachment components and thereby covers at least part of the adjustable strap.

6. Backpack with a bow-shaped frame incorporated into its backside and two carrying straps, wherein the carrying straps are attached to a strap that can be adjustably slid longitudinally on the backpack backside, said adjustable strap being connected with the backpack by free ends thereof in an area in which free ends of the bow-shaped frame end, and additionally a padded flap is applied to the bottom end of the cushion and can be connected with the backpack backside by means of attachment components, and thereby covers at least part of the adjustable strap.

7. Backpack according to claim 6, wherein the bow-shaped frame is removably positioned on the backpack backside.

8. Backpack according to claim 6, wherein the attachment components are constituted by loop and hook fastener strips or pressure buttons.

9. Backpack with a bow-shaped frame incorporated into its backside and two carrying straps, wherein the carrying straps are attached to a strap that can be adjustably slid longitudinally on the backpack backside, said adjustable strap being connected with the backpack by free ends thereof in an are in which free ends of the bow-shaped frame end, the bow-shaped frame is made of duralumin and tubing, and the center crosspiece of the bow-shaped frame is curved slightly outward, while bottom portions of sidebars thereof when in mounted position run diagonally toward each other and their middle positions, the area between their bottom portions and the center crosspiece, run essentially parallel.

10. Backpack with a bow-shaped frame incorporated into its backside and two carrying straps, wherein the carrying straps are attached to a strap that can be adjustably slid longitudinally on the backpack backside, said adjustable strap being connected with the backpack by free ends thereof in an area in which free ends of the bow-shaped frame end, the bow shaped frame is removably positioned on the backpack backside, the free ends of the bow-shaped frame can be inserted into the bottom portion of the backpack backside, while a center crosspiece of the bow-shaped frame can be inserted into a pocket in the upper portion of the backpack backside, and additionally a padded flap is applied to the bottom end of the cushion and can be connected with the backpack backside by means of attachment components and thereby covers at least a part of the adjustable strap.

* * * * *